STOVE

BACKGROUND OF THE INVENTION

1. Field of the Invention

The present invention relates to box-type wood-burning stoves and in particular to such stoves made of sheet metal.

2. Description of the Prior Art

A common approach to sheet metal stoves has been to wrap a sheet of metal cylindrically with a circular or elliptical cross-section and then fit stamped or cast ends. Rectangular stoves have used separate sheets for each surface.

Flue baffles in box stoves are generally flat rectangular plates. One prior art design is shaped like a partial cylinder curved upward at the middle and angled downward toward the rear of the stove to provide more clearance adjacent the flue aperture.

SUMMARY OF THE INVENTION

In accordance with the invention, the six surfaces of a rectangular stove are made by bending two sheets of metal into interlocking U-shapes and assembling them together. By making one sheet larger than the other, a hearth and protective flanges are provided without extra manufacturing steps. A separate feature of the inventive stove is a roof-shaped baffle plate for directing flue gasses in a preferential manner. The baffle plate is mounted with its ridge within 7.5 cm of the flue aperture and is one half to two thirds the length of the stove extending laterally to meet both sides of the stove. The enclosed angle of the plate is in the range of 130° to 145°.

Further features of the invention will become apparent upon reading the following description together with the drawing.

DESCRIPTION OF THE PREFERRED EMBODIMENT

Figure 2:
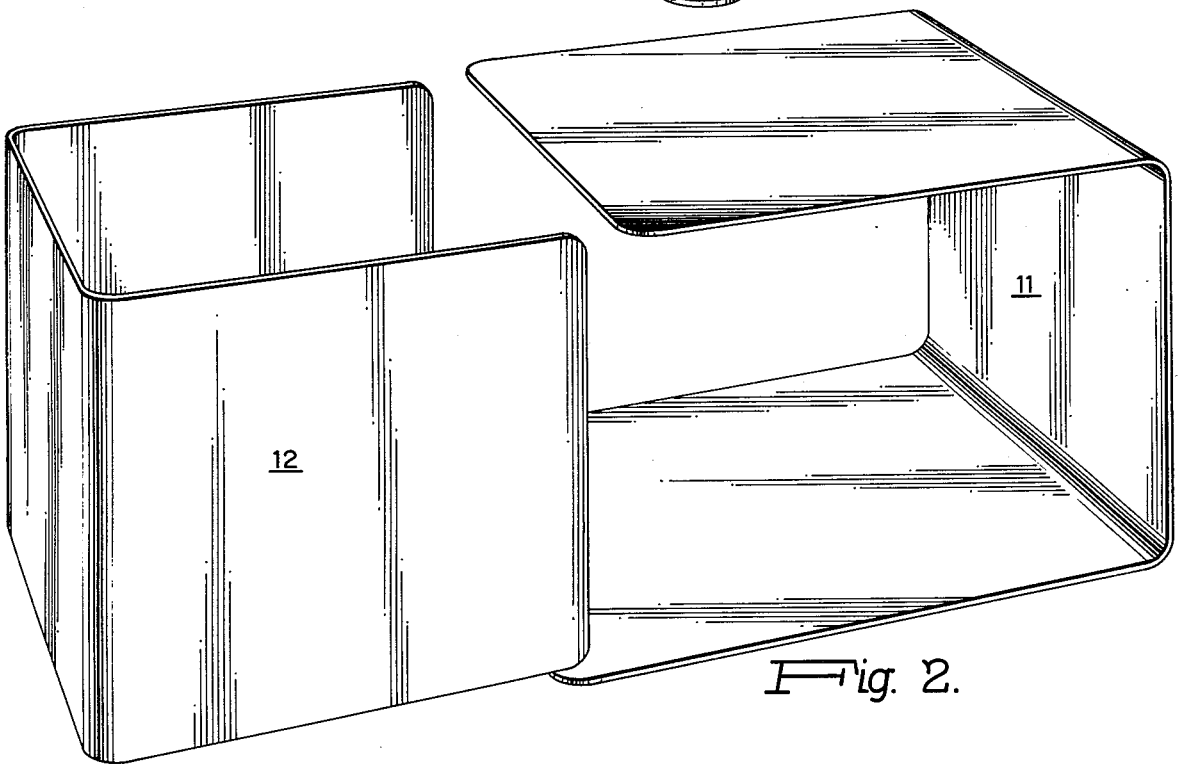
FIG. 2 is a perspective view depicting the assembly of the stove of FIG. 1.

The stove of the invention is made essentially of two sheets 11 and 12 of sheet metal bent into the form of interlocking "U" shapes as depicted in FIG. 2.

Sheet 11 forms the top, back and bottom of the stove while sheet 12 forms the front and two sides.

Figure 1:
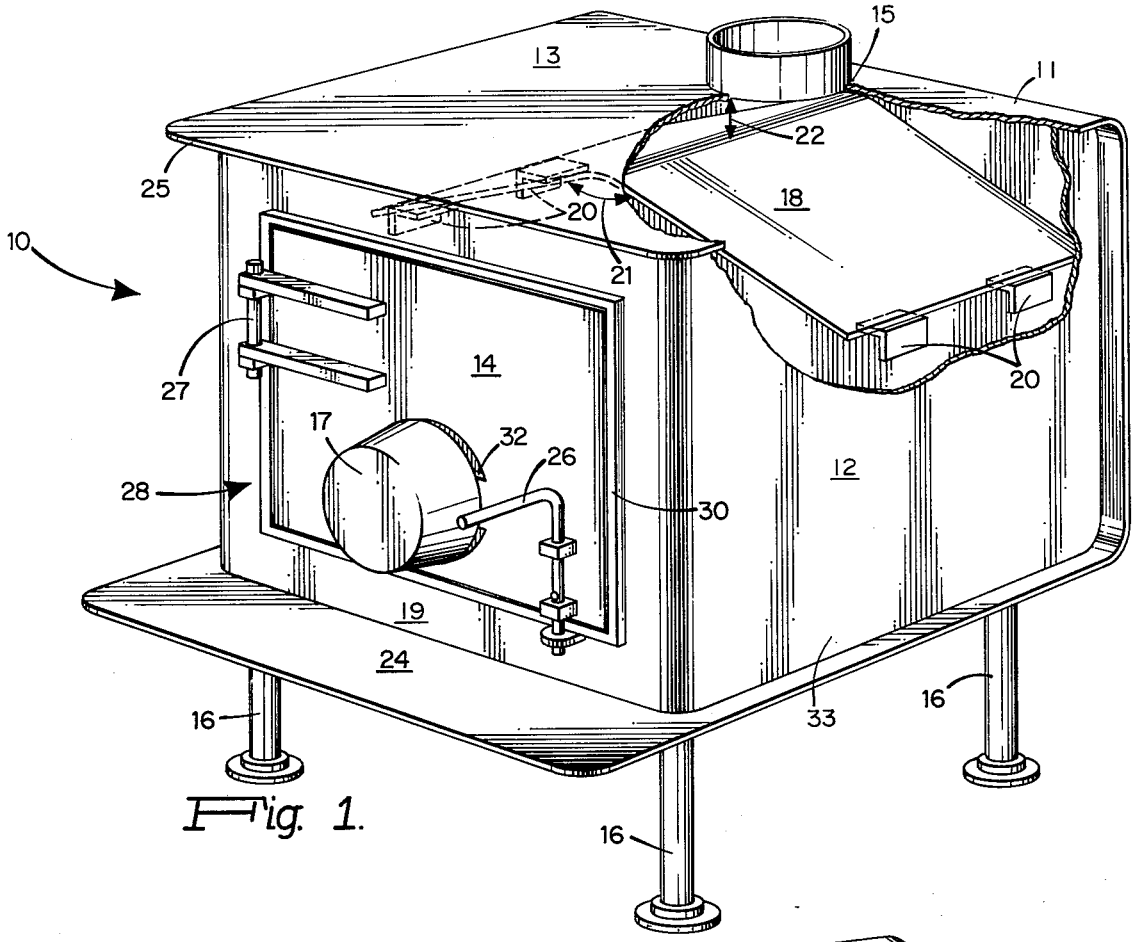
FIG. 1 is a perspective view of the inventive stove partially cut-away.

Referring to FIG. 1, top 13 of sheet 11 is cut with a circular aperture 15 for a flue pipe. Aperture 15 is preferably positioned at the rear center of top 13 but if desired can be located elsewhere as is conventional in box stoves.

Door 14 is mounted over an opening cut in front 19 of sheet 12. The stove is mounted on legs 16 depicted as pipes terminating in pipe flanges. Other suitable support means can be used to support stove 10 spaced from the floor.

Cap 17 mounted to the lower center of door 14 covers a draft vent as will be described further in relation to FIG. 3.

Roof-shaped baffle plate 13 rests on angle brackets 20 welded to sides 33 of sheet 12. Baffle plate 13 is a steel plate bent along its center line to an enclosed angle 21 in the range of 130° to 145°. Increasing the angle beyond 145° causes smoke and poor combustion while decreasing the angle below 130° causes accelerated burning and high flue temperatures.

The ridge along which plate 18 is bent faces upward and is aligned with the longitudinal axis of the stove. The ridge is spaced within a distance 22 of 7.5 cm of aperture 15. The length of plate 18 from front-to-back of the stove is preferably one half to two thirds the interior length of side 33.

Baffle plate 18 extends adjacent to the sides of the stove and may be moved forward and back. Best performance is normally obtained with plate 18 against the back of the stove. However, some stove configurations and draft conditions can result in better performance with plate 18 displaced forward.

Sheet 11 is originally longer than sheet 12 so that when the two are assembled together, sheet 11 extends forward beyond front 19 to provide hearth 24. Sheet 11 is bent in a manner such that top 13 extends beyond front 19 by a lesser amount to provide protective flange 25. Flange 25 acts as a projecting rim fending objects or persons from readily contacting the much hotter front 19. Sheet 11 may be the same width as sheet 12 rather than wider as depicted in the drawing.

Door 14 is mounted in frame 30 by hinge 27. Latch 26 is provided to secure door 14 shut.

Figure 3:
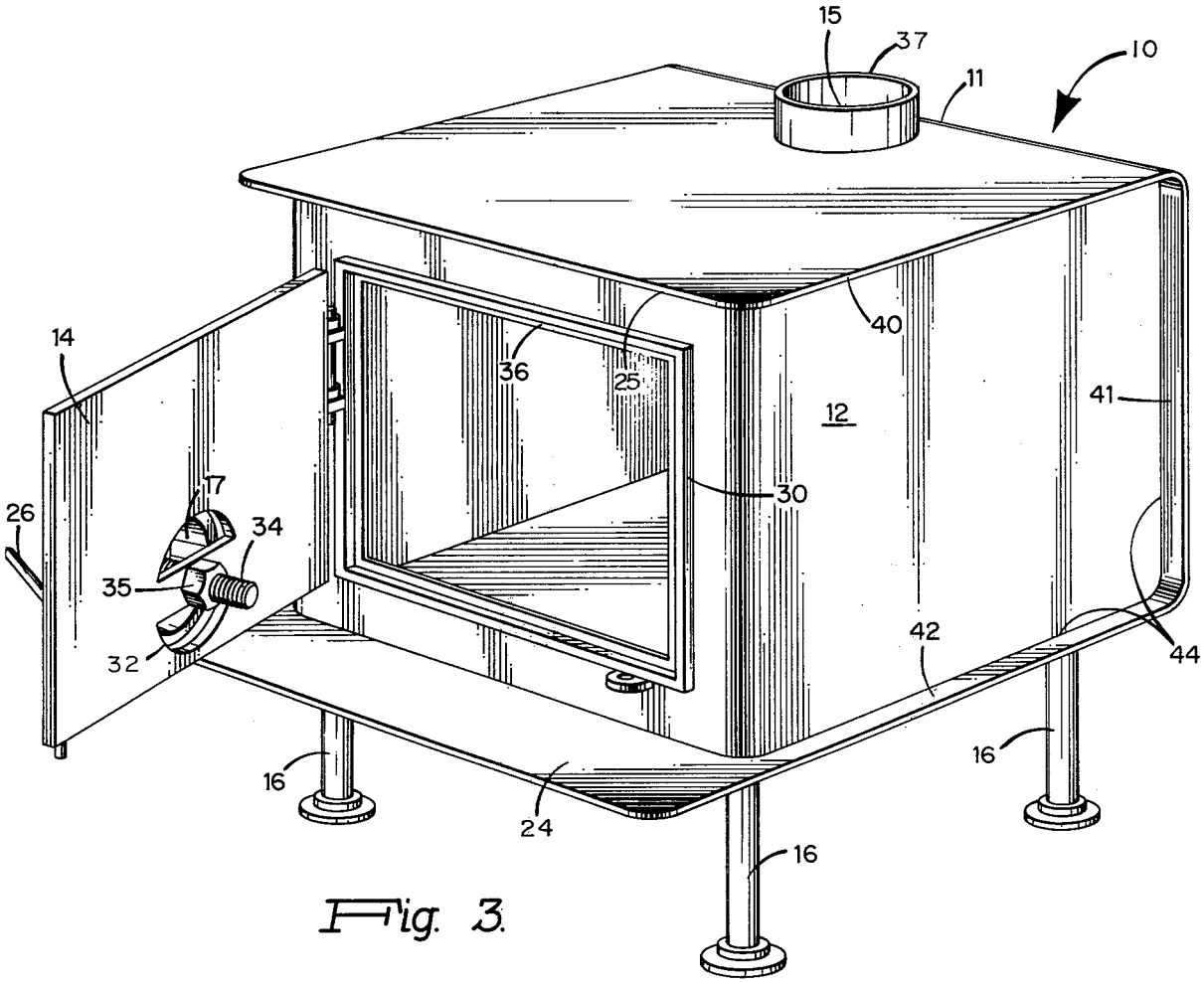
FIG. 3 is a perspective view of the stove of FIG. 1 with the door open.

Referring to FIG. 3, the details of frame 30 can be seen more clearly with door 14 open. Frame 30 has been made of four pieces of bar stock welded to front 19. The door aperture has been cut smaller than frame 30 to leave door flange 36 against which door 14 closes. In closing, door 14 fits inside frame 30 and against flange 36. Other framing can be used in which the framing stock itself provides both frame 30 and flange 36. This latter type of framing permits utilization of the piece cut from front 19 as door 14.

From the inside of door 14 it can be seen that vent cap 17 covers two half moon shaped vent holes 32. Threaded stud 34 welded to the inside center of cap 17 passes through a hole (not shown) midway between vent holes 32 and threads into nut 35. Nut 35 is welded to door 14 over the hole between vent holes 32. With this arrangement, rotating vent cap 17 opens and closes the air path to vent holes 32. As depicted in FIG. 3, sheet 11 is both longer and wider than sheet 12 providing a hearth 24, a front overhang 25, side overhangs 40, rear flanges 41 and skirts 42.

A weld bead 44 along the inside of hearth 24, front and side overhangs 25 and 40, rear flange 41 and skirt 42 secures sheets 11 and 12 together.

The stove may also be bolted together instead of welding, for example by welding nuts at appropriate positions about the inside of sheet 12 and then threading bolts through from the outside of sheet 11 into the nuts. While the sheet metal from which the stove is made has to be a compromise between the factors of weight, cost, safety and durability, stoves have been made using $\frac{3}{8}$ inch sheet steel for sheets 11 and 12 and $\frac{3}{8}$ inch sheet steel for door 14 and baffle 18. Other types of hinges, latches and vents can be used and the ones depicted are given as exemplary.

Collar 37 for receiving a flue pipe is preferably provided welded over aperture 15.

While the invention has been described with relation to specific embodiments, obvious variations are contem-

United States Patent [19]

Grott

[11] 4,121,562

[45] Oct. 24, 1978

[54] ENERGY CONSERVATION KIT FOR HOUSEHOLD FURNACES

[76] Inventor: Frank S. Grott, 3401 Fielding Rd., Baltimore, Md. 21208

[21] Appl. No.: 584,657

[22] Filed: Jun. 6, 1975

[51] Int. Cl.[2] ..... F24C 3/00

[52] U.S. Cl. ..... 126/85 B

[58] Field of Search ..... 126/112, 15 R, 77, 85 B; 110/157; 431/89, 30, 31; 248/DIG. 6

[56] References Cited

U.S. PATENT DOCUMENTS

| | | | |
|---|---|---|---|
| B 424,415 | 1/1975 | Perrault | 248/DIG. 6 |
| 2,335,471 | 11/1943 | Ashcraft | 431/31 X |
| 2,370,205 | 2/1945 | Tate | 431/30 |
| 2,711,683 | 6/1955 | Ryder | 98/46 X |
| 3,315,657 | 4/1967 | Jenson et al. | 126/85 X |
| 3,601,116 | 8/1971 | Davis | 126/85 X |
| 3,667,450 | 6/1972 | Skafte | 126/85 B |
| 3,906,925 | 9/1975 | Dyer | 126/85 B X |

*Primary Examiner*—William E. Wayner
*Assistant Examiner*—William E. Tapolcai, Jr.
*Attorney, Agent, or Firm*—Berman, Aisenberg & Platt

[57] ABSTRACT

A kit for converting presently used household or light commercial furnaces of the oil or gas type which inefficiently consume unnecessarily large quantities of fuel, to a more efficient mode of operation wherein smaller quantities of fuel are consumed. The kit comprises prefabricated components which can be easily attached to the furnace in such a way that fresh air is brought in from the outside to support the combustion process, and meet the needs of the draft diverter, rather than using already heated and/or humidified air as is done in presently existing systems.

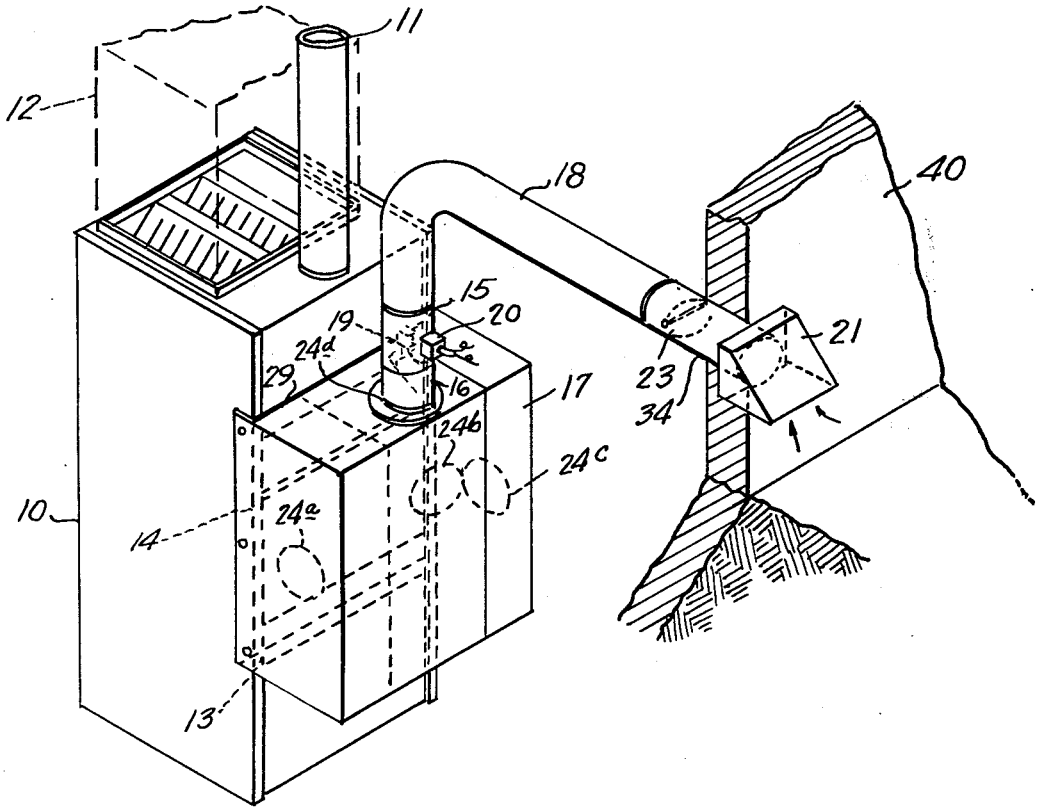

7 Claims, 11 Drawing Figures